US007522042B2

(12) United States Patent
Milo

(10) Patent No.: US 7,522,042 B2
(45) Date of Patent: Apr. 21, 2009

(54) DOOR ACCESSORY POWER SYSTEM

(75) Inventor: Thomas K. Milo, Akron, OH (US)

(73) Assignee: T.K.M. Unlimited, Inc., Akron, OH (US)

( * ) Notice: Subject to any disclaimer, the term of this patent is extended or adjusted under 35 U.S.C. 154(b) by 310 days.

(21) Appl. No.: 11/419,098

(22) Filed: May 18, 2006

(65) Prior Publication Data

US 2007/0268132 A1 Nov. 22, 2007

(51) Int. Cl.
*G08B 13/08* (2006.01)

(52) U.S. Cl. ..... 340/545.1; 340/539.1; 292/251.5

(58) Field of Classification Search ..... 340/545.1, 340/539.1, 539.3, 547, 545.6, 545.7, 693.1–693.4; 49/280; 292/251.5; 310/14
See application file for complete search history.

(56) References Cited

U.S. PATENT DOCUMENTS 3,696,359 A * 10/1972 Ross et al. ..... 340/547
3,772,669 A * 11/1973 Johnston et al. ..... 340/539.1
3,896,427 A * 7/1975 Campman ..... 340/547
4,843,374 A * 6/1989 Sansky ..... 340/547
5,184,855 A * 2/1993 Waltz et al. ..... 292/251.5
6,289,643 B1 * 9/2001 Bonar ..... 49/505
6,741,160 B1 5/2004 Dawson et al.
7,267,378 B2 * 9/2007 Drumm ..... 292/251.5
2006/0242908 A1 * 11/2006 McKinney ..... 49/280
2007/0222584 A1 * 9/2007 Albsmeier et al. ..... 340/539.1
2008/0100152 A1 * 5/2008 Busch ..... 310/14

* cited by examiner

*Primary Examiner*—John A Tweel, Jr.
(74) *Attorney, Agent, or Firm*—Fay Sharpe LLP

(57) ABSTRACT

A powered door accessory system generally includes a powered door accessory assembly, a generator, and a power storage device. In an embodiment, the powered door accessory assembly includes an electric drive and a driven member operatively connected to the electric drive. The generator is in electrical communication with the electric drive of the powered door accessory assembly and the power storage device. A method for operating a door accessory assembly is also disclosed.

21 Claims, 10 Drawing Sheets

DOOR ACCESSORY POWER SYSTEM

BACKGROUND

Many doors include or cooperate with powered locks and/or powered door latch actuators, both of which can be generically referred to as door accessory assemblies. Powered lock assemblies are used to automatically lock and unlock a door. Powered door latch assemblies are used to automatically move a door latch from a latched condition to an unlatched condition. These powered door accessory assemblies are sometimes battery operated but are typically hard wired and powered by electricity that is also used to power other electrical components for the building to which the door is mounted.

Typically after the door is unlocked or unlatched using one of the aforementioned door accessory assemblies, the door is then opened. Mechanical energy is required to open the door, be it a door mounted on hinges or a sliding door. Energy is also required to close the door. At present there is no means to collect the kinetic energy associated with a moving door and to use this energy to power the aforementioned powered door accessory assemblies.

SUMMARY OF THE INVENTION

A powered door accessory system generally includes a powered door accessory assembly, a generator, and a power storage device. In an embodiment, the powered door accessory assembly includes an electric drive and a driven member operatively connected to the electric drive. The generator is in electrical communication with the electric drive of the powered door accessory assembly and the power storage device.

A method for operating a door accessory assembly comprises the following steps: driving a driven member between a first position and a second position via an electric drive of a powered door accessory assembly; generating electrical power by moving a member operatively connected to a door; storing the generated electrical power in a power storage device; and delivering at least some of the generated electrical power to the electric drive.

DETAILED DESCRIPTION

A powered door accessory system will be described with reference to embodiments described below. The powered door accessory system transfers kinetic mechanical energy associated with a moving door into potential electrical energy that can power a powered door accessory assembly.

Figure 1:
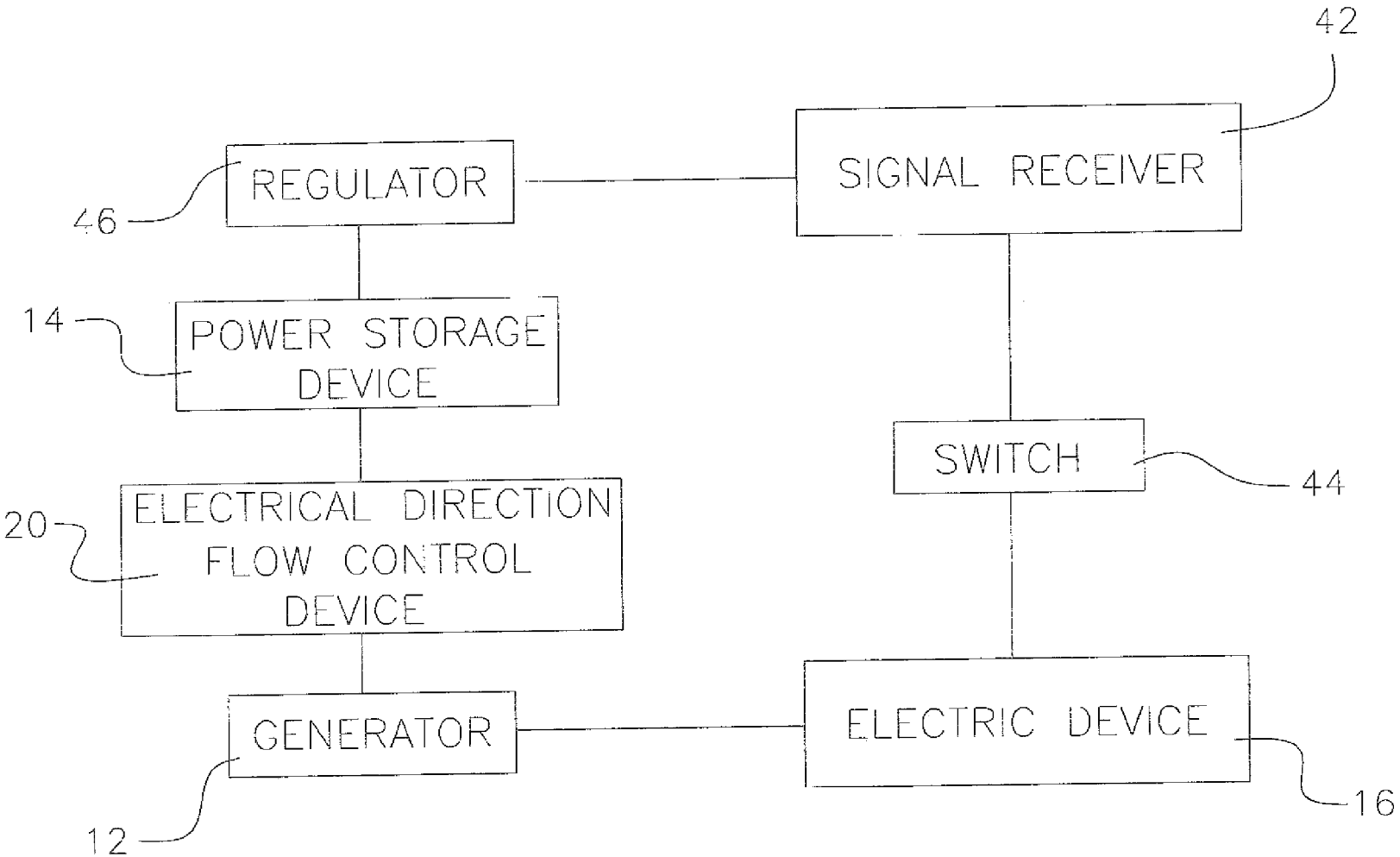
FIG. 1 is a schematic view of a portion of a door accessory system.
Figure 2:
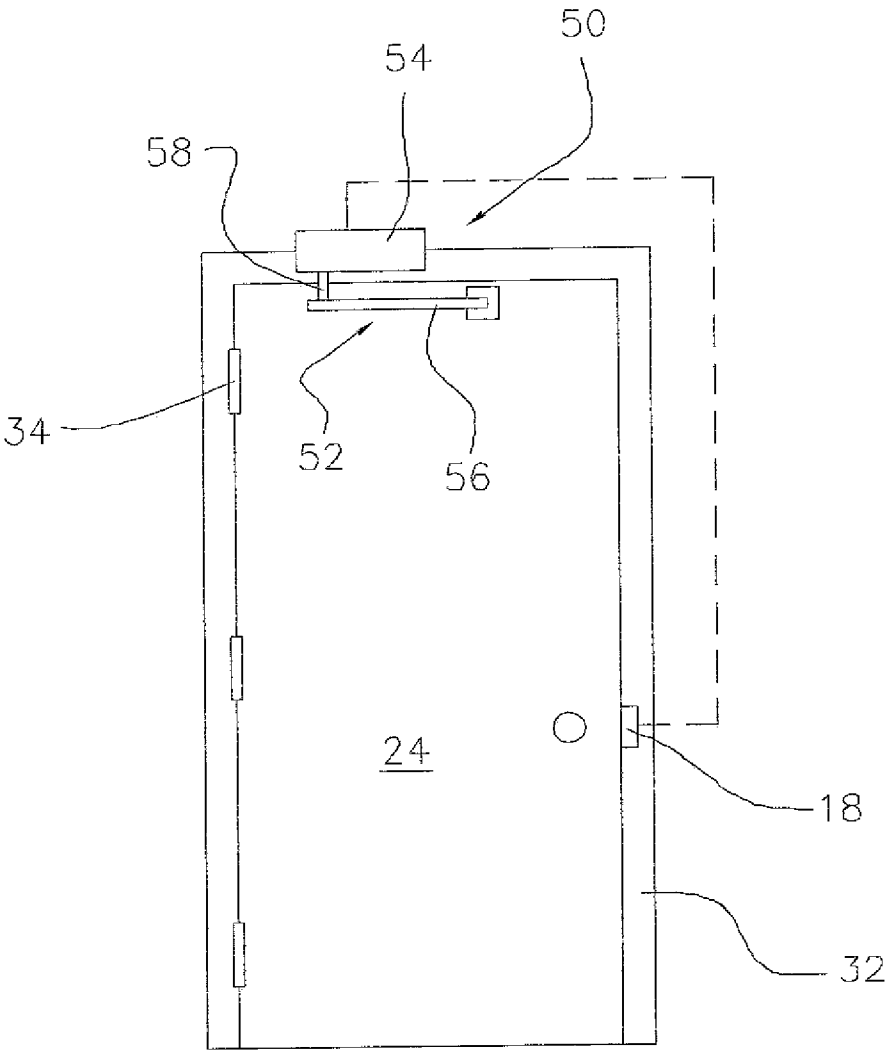
FIG. 2 is a schematic view of a door accessory system for a swinging door.
Figure 5:
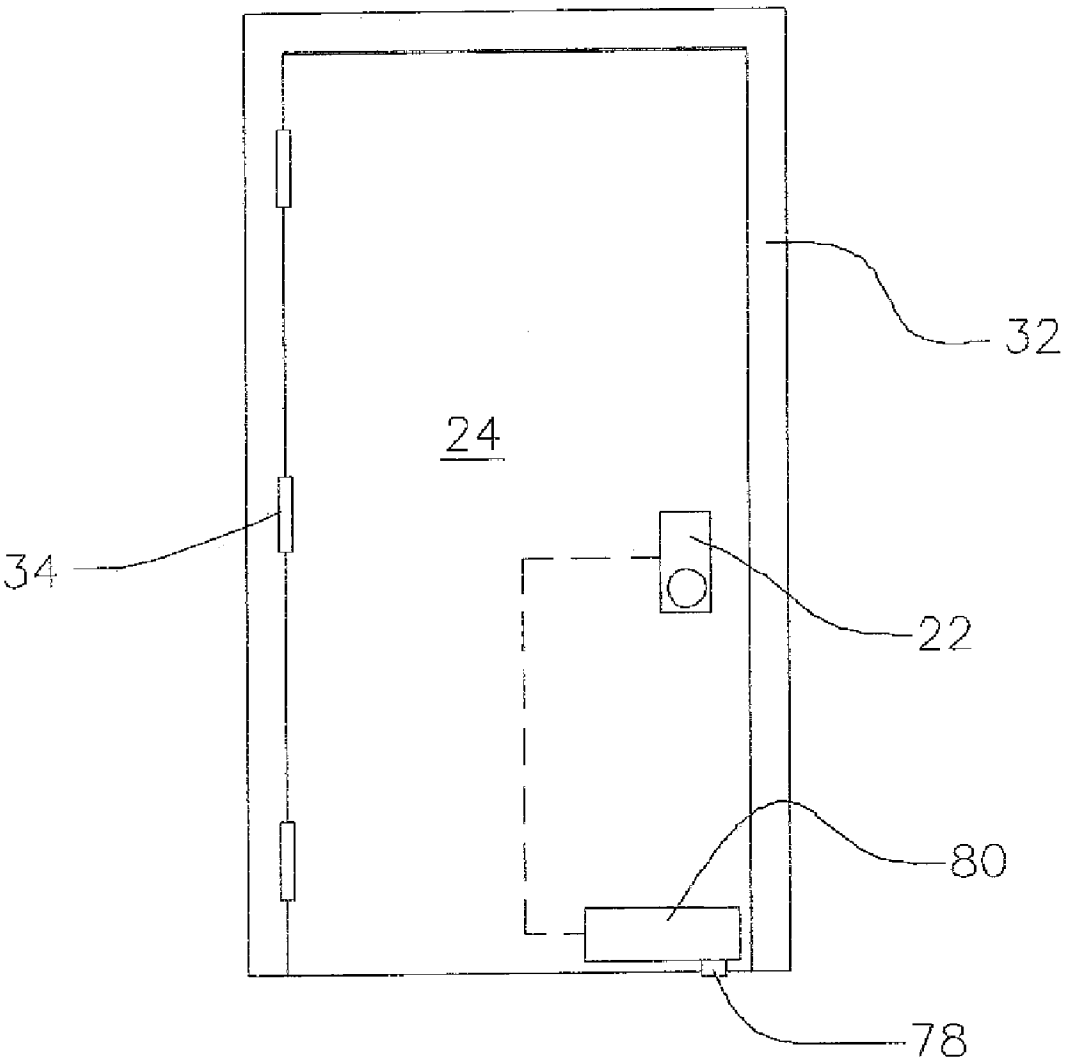
FIG. 5 is a schematic view of an alternative embodiment of a door accessory system for a swinging door.
Figure 6:
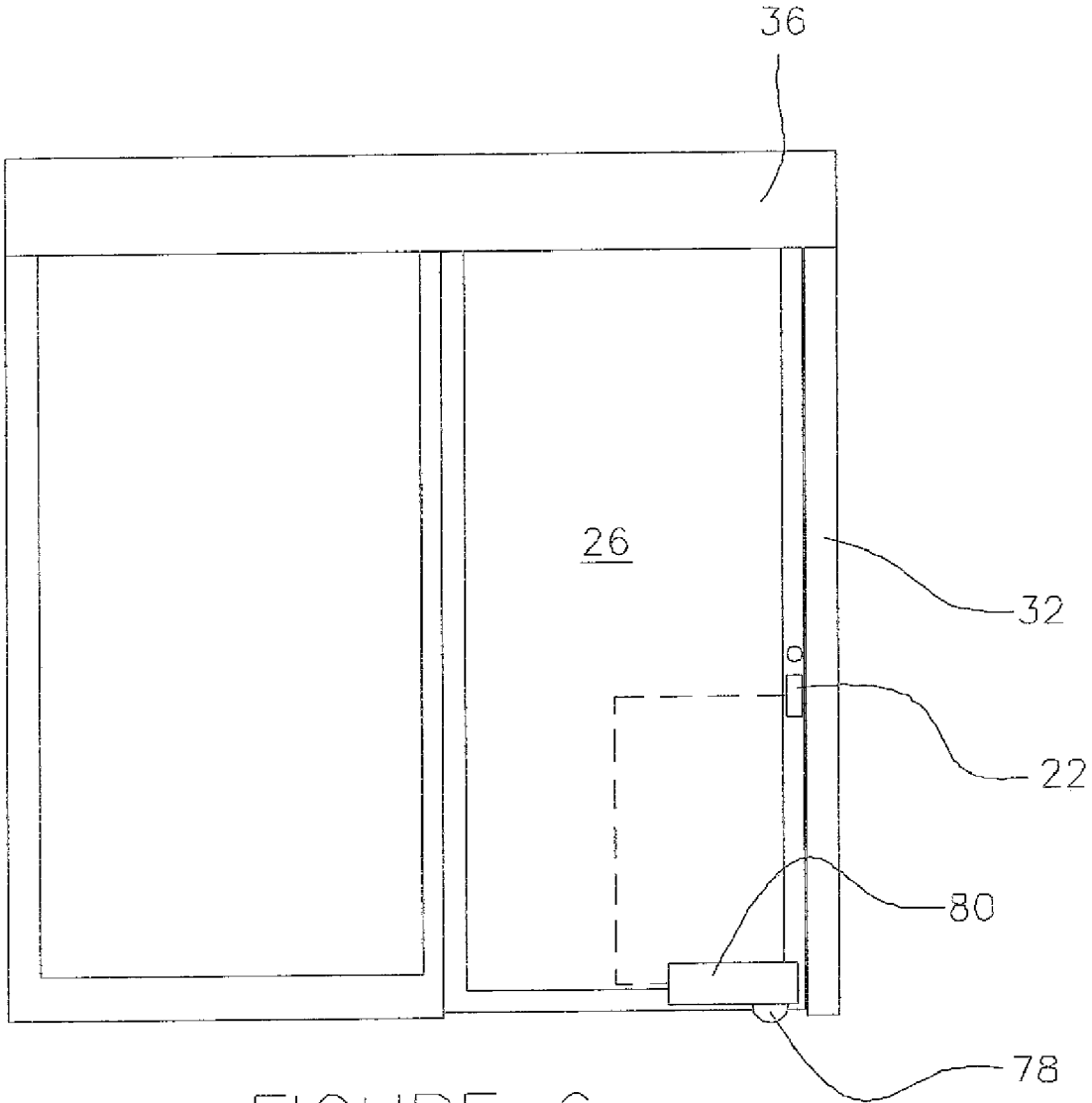
FIG. 6 is a schematic view of a door accessory system for a sliding door.
Figure 7:
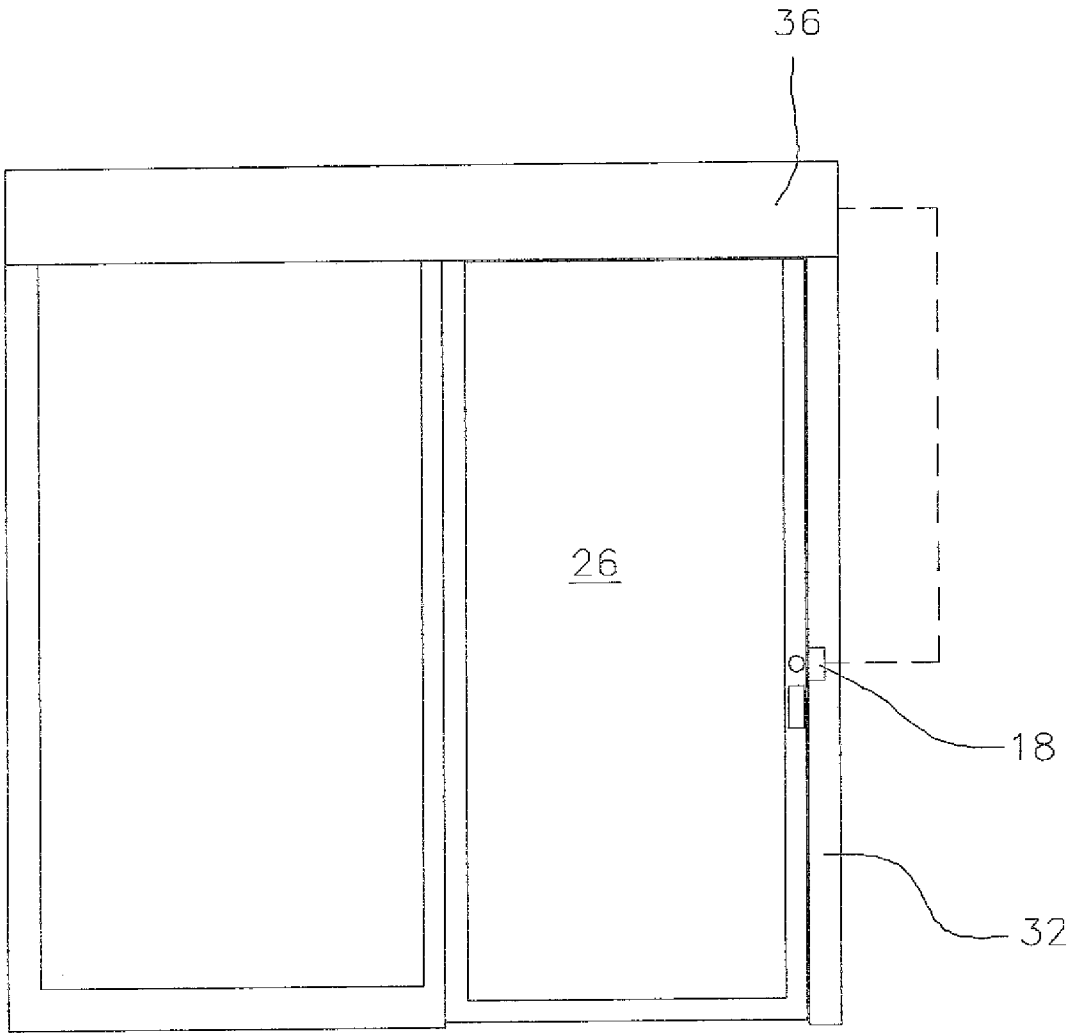
FIG. 7 is a schematic view of an alternative embodiment of a door accessory system for a sliding door.

With reference to FIG. 1, an embodiment of powered door accessory system generally includes a generator 12 and a power storage device 14, each of which are in electrical communication with an electrically powered device 16 of a powered door accessory assembly, examples of which are schematically depicted as a powered door latch actuator 18 in FIGS. 2 and 7 and as a powered door lock 22 in FIGS. 3-6. An electrical direction flow control device 20, for example a diode can be interposed between the power storage device 14 and the generator 12 to control the direction of current flow so that current does not flow from the power storage device towards the generator. The powered door accessory assembly can include a powered door latch actuator, a powered lock assembly, as mentioned above, or another automated assembly that cooperates with a door, and requires electricity to operate, for example an electric door opener, a push plate actuator, a card reader, an electronic eye, etc. The powered door accessory assembly can cooperate with many different types of doors, e.g. a swinging door 24 (FIGS. 2-5), a sliding door 26 (FIGS. 6-7) and/or a revolving door. For the sake of brevity, the powered door accessory system will be described with reference to a powered door accessory assembly such as a powered door lock and/or a powered door latch actuator, also referred to as an electric strike; however, the system is not limited to working with only these assemblies.

The power storage device 14 includes a capacitor, a battery, and combinations thereof. The power storage device 14 provides electrical power to the electric device 16 in a manner that will be described in more detail below. Also, the power storage device 14 can provide power to other electrical components that are associated with the door accessory system, for example the signal receiver, a light, an electronic eye, etc.

As mentioned above, examples of the door accessory assembly include a door latch actuator 18 (FIGS. 2 and 7) such as that described in U.S. Published Patent Application No. US2005/0184539, which is incorporated by reference herein. Also, the door accessory assembly can include a door latch actuator similar to the type described in U.S. Pat. No. 6,581,991, which is also incorporated by reference herein. These door latch actuators include at least one electrical device 16 (FIG. 1), e.g. an electric drive, that is in electrical communication with the generator 12 and the power storage device 14. These door latch actuators include a movable member that engages at least one of a spring latch bolt (not visible in the FIGURES) and a latch bolt pin (not visible in the FIGURES) to selectively unlatch a door, for example a swinging door 24 in FIG. 2 and a sliding door 26 in FIG. 7. The movable member can either rotate or move in a linear direction. In the depicted embodiment, the door latch actuator 18 mounts inside a doorjamb 32 (FIGS. 2 and 7). The swinging door 24 mounts to the door jamb 32 via hinges 34 (FIG. 2). The sliding door 26 mounts to the doorjamb 32 via a track 36 (FIG. 7).

Another example of a powered door accessory assembly includes a powered door lock 22 (FIGS. 3-6) such as that described in U.S. Published Patent Application No. US 2005/0132766, which is incorporated by reference herein. The powered door lock also includes a movable member, e.g. a deadbolt (rotary or linear), that is selectively received inside of a deadbolt cavity in a door jamb 32 to lock a door, for example the swinging door 24 depicted in FIGS. 3-5 and the sliding door 26 depicted in FIG. 6. As shown in the figures, the powered door lock 22 mounts to, either inside (so as not to be visible) or outside, the respective door and the movable member is received inside a cavity formed in the door jamb 32. Alternatively, the powered door lock 22 can mount to the door jamb 32 and cooperate with a deadbolt cavity formed in the respective door.

Each of the aforementioned powered door accessory assemblies, i.e. the powered door latch actuator 18 and the powered door lock 22, includes an electric drive, which can be an electric motor, a solenoid, or a wire made from a material that expands and contracts when a current passes through the wire, that is operably connected to the movable member. For the aforementioned powered door accessory assemblies, the electric drive for each device coincides with the electrical device 16 depicted schematically in FIG. 1. Nevertheless, if the powered door accessory assembly includes more than one electrical device, for example an additional motor, a light, or the like, these electrical devices can also be in electrical communication with the generator 12 and the power storage device 14. For the door latch actuator 18, the electric drive moves at least one movable member between a first, or extended, position and a second, or retracted, position to move or allow the movement of a spring latch bolt, a latch bolt pin or both. For the powered lock, the electric drive moves a movable member, e.g. a deadbolt, between a first position and a second position to lock and unlock the door.

With reference to FIG. 1, the generator 12 includes a magnet in relation to a coil of wire, or vice versa, to induce an electrical current and voltage. An example of such a device is known as a dynamo. Additionally, more than one magnet and/or coil of wire can be provided. In one embodiment, a movable member is operatively connected to the door, either swinging door 24 or sliding door 26, in a manner such that movement of the door, opening and/or closing, imparts movement of the movable member. The movable member includes a gear, a rack, a wheel (each of which are described below), a pulley, an arm, a sprocket, a cam, a plunger, a rod, a cable or other component that is operatively connected to at least one of the magnet and the coil of wire. The generator 12 is in electrical communication with a power storage device 14. The power storage device 14 stores the electrical energy generated by the generator 12 to power the electric device 16.

With reference back to FIG. 1, the powered door accessory system also includes a signal receiver 42 that is in electrical communication with the generator 12, the power storage device 14, and the electric device 16. The signal receiver 42 includes any device that is configured to receive a signal from an access controller, e.g., a key pad, a biometric reader, a card reader, which can be hard wired to the signal receiver or wirelessly remote from the signal receiver. The signal receiver 42 can also be configured to receive a signal from a push button, a keyfob, a card reader, a mechanical actuator, or the like. The signal receiver 42 closes a switch 44 interposed between the electric device 16 and the power storage device 14 so that electrical power is delivered from the power storage device 14 to the electric device 16. Alternatively, the signal receiver 42 can be incorporated into the switch 44 or removed from the system where only a switch may be desirable. In other words, the switch may include the signal receiver.

In the embodiment depicted in FIG. 1, a regulator 46 is interposed between the power storage device 14 and the electric device 16 so that the proper current and voltage is supplied to the electric device from the power storage device. The locations of the components along the circuit depicted in FIG. 1 can be altered and the exact locations are not limited to only those locations that are depicted.

Figure 3:
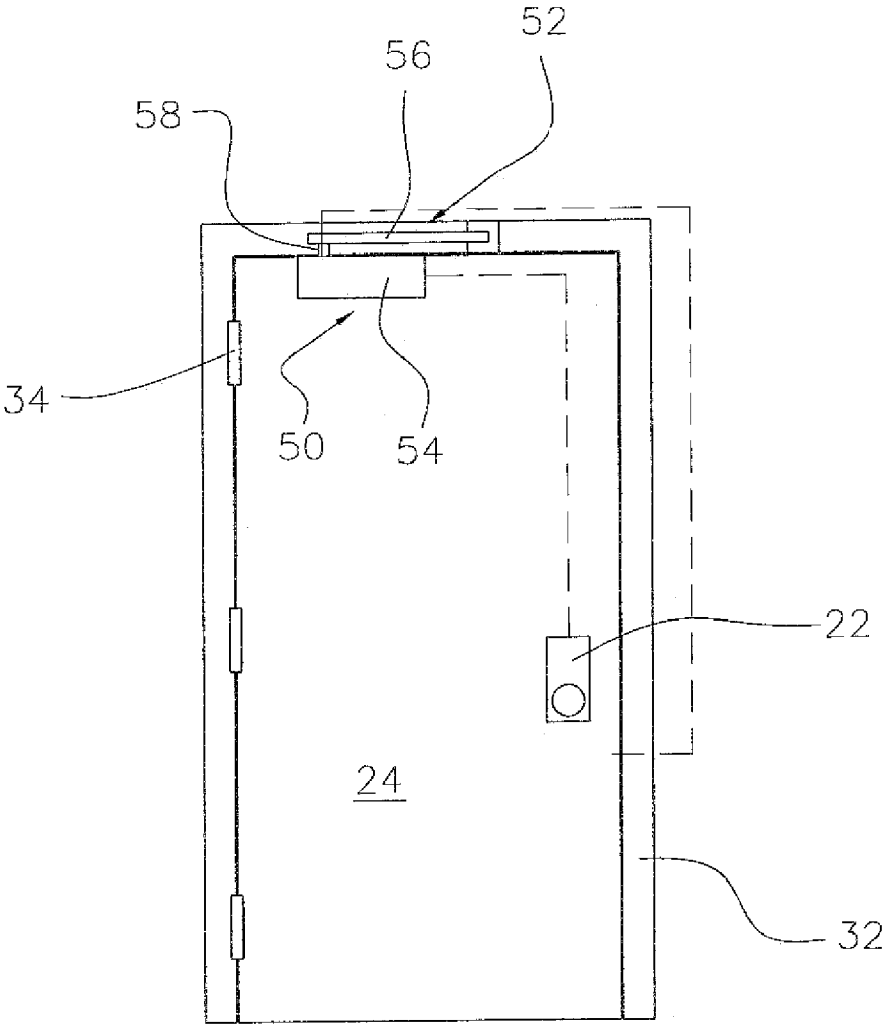
FIG. 3 is a schematic view of an alternative embodiment of a door accessory system for a swinging door.

As mentioned above, the movable member of the generator 12 is operatively connected to the door 24 or 26 so that movement of the door results in movement of a magnet in relation to a coil of wire, or vice versa. With reference to FIGS. 2 and 3, the movable member of the generator 12 (FIG. 1) is mounted to or in an automatic door closer 50. The automatic door closer 50 is similar to those that are known in the art, except that it includes, or has connected to it, many or all of the components depicted in FIG. 1. Accordingly, as seen in FIG. 2, the automatic door closer 50 mounts to the doorjamb 32, and/or a wall to which the doorjamb attaches. As seen in FIG. 3, the automatic door closer 50 mounts to the door 24. Since the door latch actuator 18 is disposed in the door jamb 32 in FIG. 2, the automatic door closer 50 mounts to the door jamb 32 and/or wall to provide for an electrical connection between the generator 14, which is disposed in the door closer 50, and the door latch actuator 18. Since the powered door lock 22 is mounted to the door 24 in the embodiment depicted in FIG. 3, the automatic door closer 50 is mounted to the door 24 to provide for an easy electrical connection between the generator 14, which is disposed in the automatic door closer 50, and the powered door lock 22.

The automatic door closer 50 includes a biased arm 52 that attaches to the door 24 and a housing 54 that houses components that bias the arm 52 and other components, such as the generator and power storage device, if desired. When the door 24 is opened, a biasing member, for example a hydraulic piston, a pneumatic piston, a spring, etc., biases the arm 52 back to the closed position to automatically close the door 24 after it has opened. The biased arm 52 in the embodiments depicted in FIGS. 2 and 3 include a horizontal member 56 and a vertical member 58. In an alternative embodiment, an automatic door opener, which has a similar configuration to the automatic door closer 50, that both opens and closes the door, can also be provided. The automatic door opener includes a motor (not shown) disposed in a housing, similar to the housing 54, that rotates a member, similar to the vertical member 58, to move a member, similar to the horizontal member 56, to open a door.

In the depicted embodiment, the generator 12 (FIG. 1) is disposed inside the housing 54. In the depicted embodiment, the vertical portion 58 of the arm 52 rotates when the door opens and closes. The movable member (not visible) of the generator 12 to which a magnet or a coil of wire is attached is operatively connected to the vertical portion 58. Such a connection can be through a transmission. In the embodiment, the magnet moves in relation to the coil of wire (not visible), or vice versa, that is disposed in the housing 54 to induce an electrical current. A plurality of gears can be provided to increase the number of revolutions of the movable member per each revolution of the vertical portion 58 to increase the electrical current and voltage that is being induced by movement of the magnet and/or the coil of wire. Where the arm 52 is biased by a pneumatic or hydraulic piston, the movable member and magnet and/or coil of wire can operatively attach to the plunger of the pneumatic piston and/or the hydraulic piston. When the piston moves and/or biases the arm 52 back to the closed position, the magnet moves through the coil, or vice versa, disposed in the housing 54 to generate an electrical voltage and current. This electrical voltage and current is delivered to the power storage device 14 where it is stored until the switch 44 is closed thus delivering power to the electric device 16. This electrical voltage and current can power other components of the powered door assembly.

Figure 4:
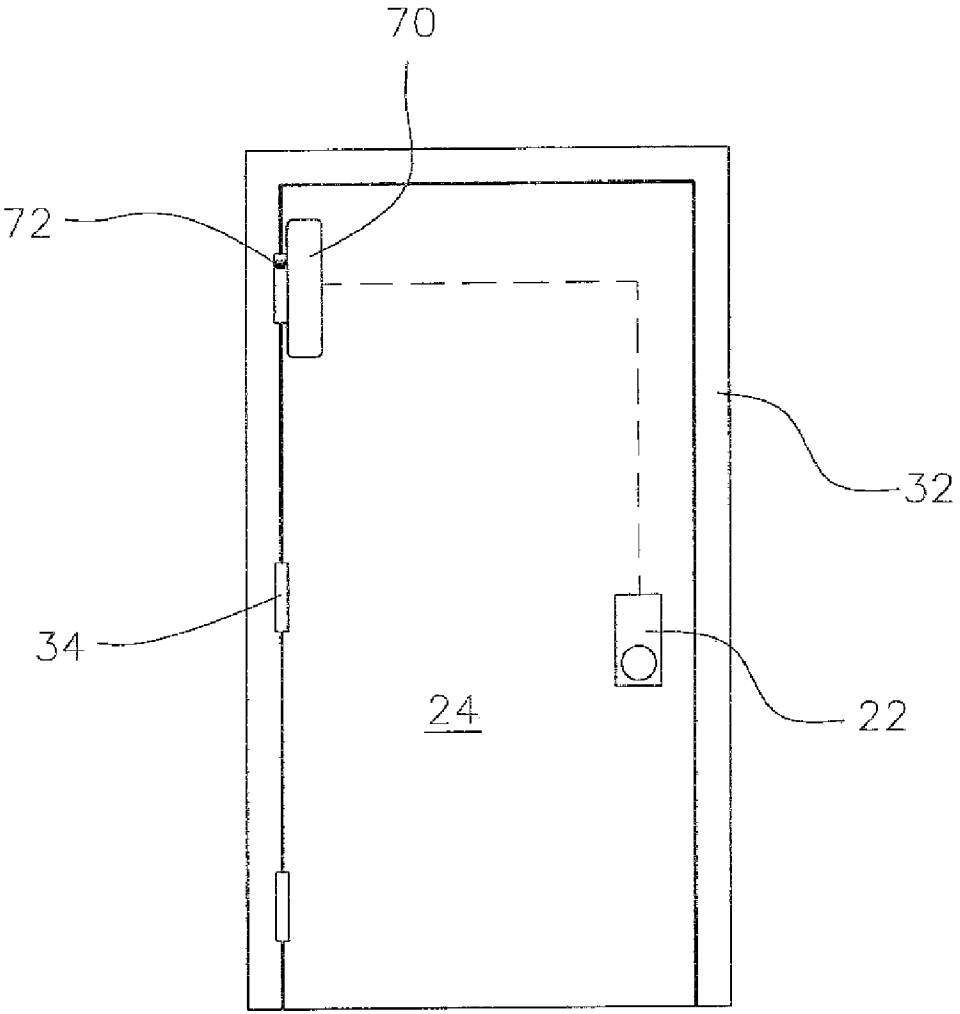
FIG. 4 is a schematic view of an alternative embodiment of a door accessory system for a swinging door.
Figure 8:
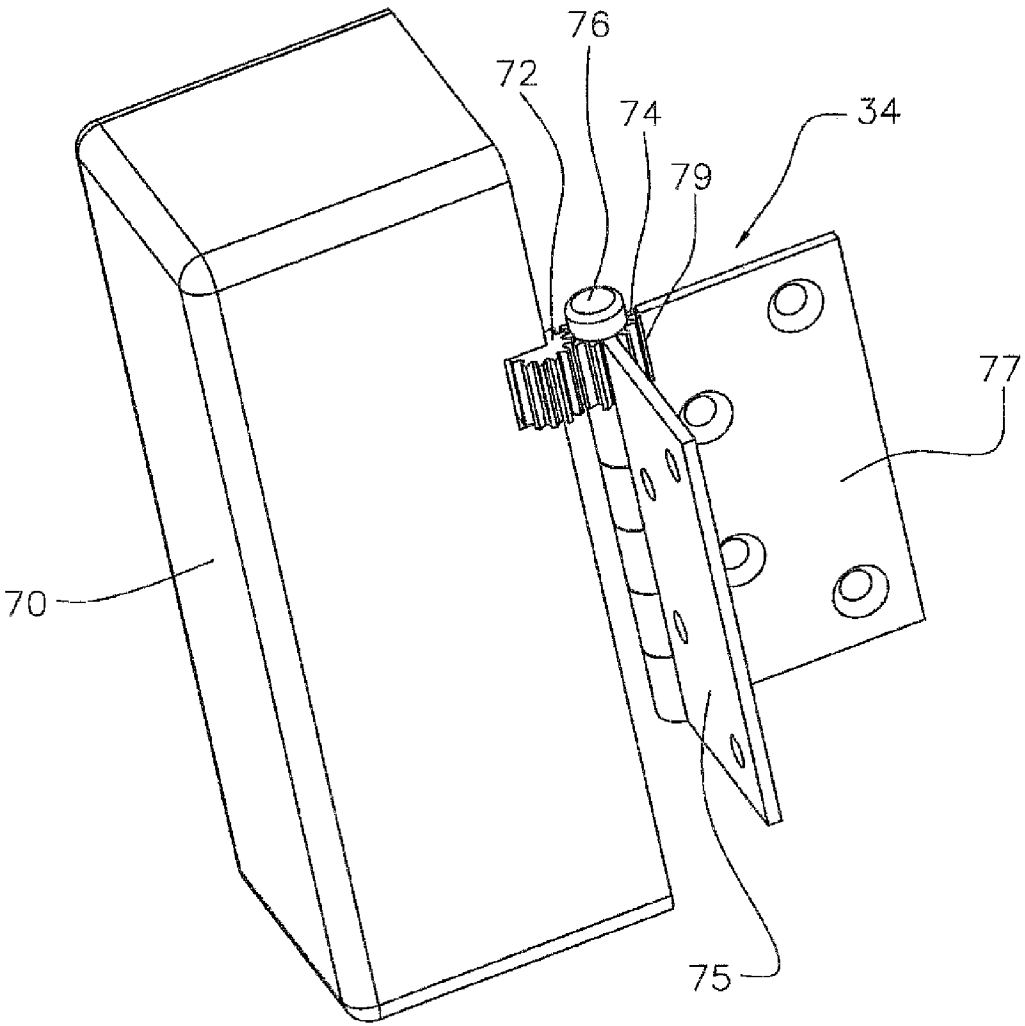
FIG. 8 is a perspective view of a generator housing and gear arrangement showing a connection between a hinge for a door and moveable member of a generator of the door accessory system.

As mentioned above, the generator 12 (FIG. 1) can operatively attach at any number of locations on a door and/or door jamb so long as movement of the door results in movement of the magnet or the coil of wire. For example, with reference to FIG. 4 a gear 72 mounted to a housing 70 can be operatively connected to the hinge 34 of the swinging door 24. As more clearly seen in FIG. 8, the gear 72 can cooperate with the hinge 34 such that rotation of the door results in movement of the magnet or the coil of wire of the generator 12. The components of the generator 12 and the power storage device 14 can be disposed in the housing 70 that mounts to the door 24 and/or the door jamb 32 (FIG. 4). Alternatively, the generator can be disposed in a housing that mounts to the door jamb 32, for instance where the generator is in electrical communication with an electric strike such as that disclosed in FIG. 2. The gear 72 to which the magnet and/or coil attaches (which can be through a transmission, or similar) can operatively connect to a sprocket 74 that mounts to a pin 76 of the hinge 34. A first plate 75 of the hinge 34 is integral with or connected to the sprocket 74. In the depicted embodiment, the sprocket 74 is missing a gear and the first plate 75 extends from that location. A second plate 77 of the hinge 34 includes a notch 79 so that the second plate can move without contacting the sprocket 74. The gear 72 includes teeth that engage the sprocket 74 such that movement of the swinging door 24, which is attached to the hinge 34, results in movement of the gear. The gear 72 can attach to a spring and clutch mechanism such that as the swinging door 24 is opened and/or closed the gear 72 tightens or biases the spring. When the door 24 moves past a certain location, the clutch can either engage or disengage resulting in the spring biasing the gear 72 (to which the magnet and/or coil is operatively attached) imparting quick rotational movement of the gear.

In one embodiment, the coil of wire is disposed in relation to a movable member, which can either be the gear 72 or a member operatively connected to the gear, such that movement of the magnet induces an electrical current and voltage in the coil of wire as the moveable member rotates or moves with respect to the coil of wire. This coil of wire and magnet configuration is not limited to only one coil or magnet and the coil can rotate in proximity to the magnet or any combination thereof. The clutch mechanism and biased moveable member can have a similar configuration to a conventional egg timer, a toy wind-up car or similar device.

Figure 9:
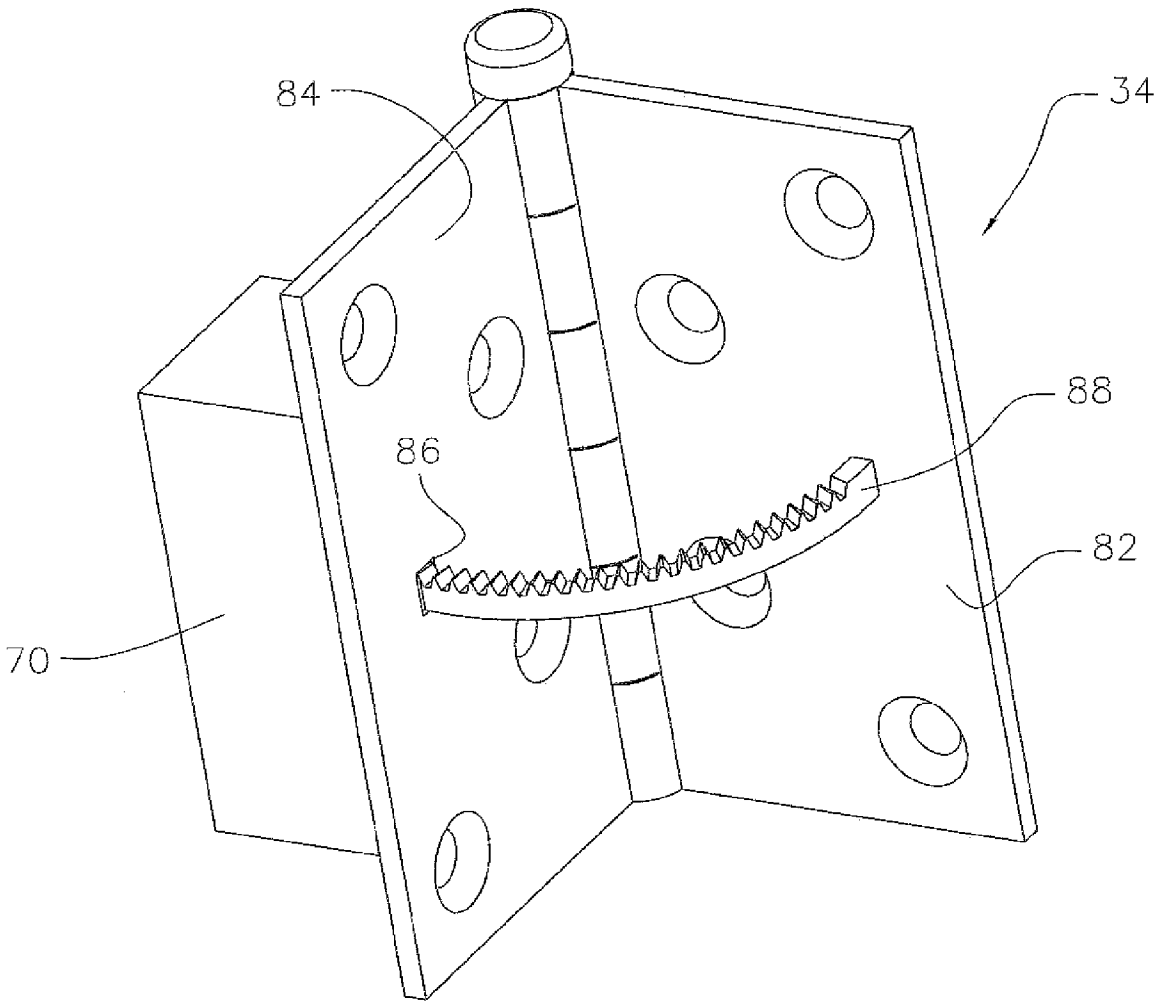
FIG. 9 is a perspective view of a rack and pinion arrangement and generator housing for the door accessory system.

With reference to FIG. 9, an alternative arrangement for providing movement of the magnet in relation to the coil of wire, or vice versa, is shown using a rack 88 that is attached to the hinge 34. A first end of the rack 88 attaches to a first plate 82 of the hinge 34. A second plate 84 of the hinge includes an opening 86 through which the rack 88 can travel.

The rack 88 operatively connects to the magnet or the coil of wire, e.g., via a transmission, such that movement of the door to which the hinge 34 is attached results in movement of the rack 88 which results in movement of the magnet in relation to the coil of wire or vice versa. The rack 88 can also cooperate with a spring and clutch mechanism that was described above with reference to the gear as shown in FIG. 8.

With reference to FIGS. 5 and 6, the movable member of the generator 14 (FIG. 1) can also include or operatively connect to a wheel 78, or other ground engaging mechanism, such that movement of the wheel 78 upon opening and closing of the door 24 (FIG. 5) and 26 (FIG. 6) results in movement of the movable member. The generator 14 (only visible in FIG. 1) can be disposed in a housing 80 that mounts to the respective door. Similar to the embodiments described above. The moveable member can be operatively connected to wheel 78 via a transmission so that each revolution of the wheel 78 results in multiple revolutions of the movable member.

Figure 10:
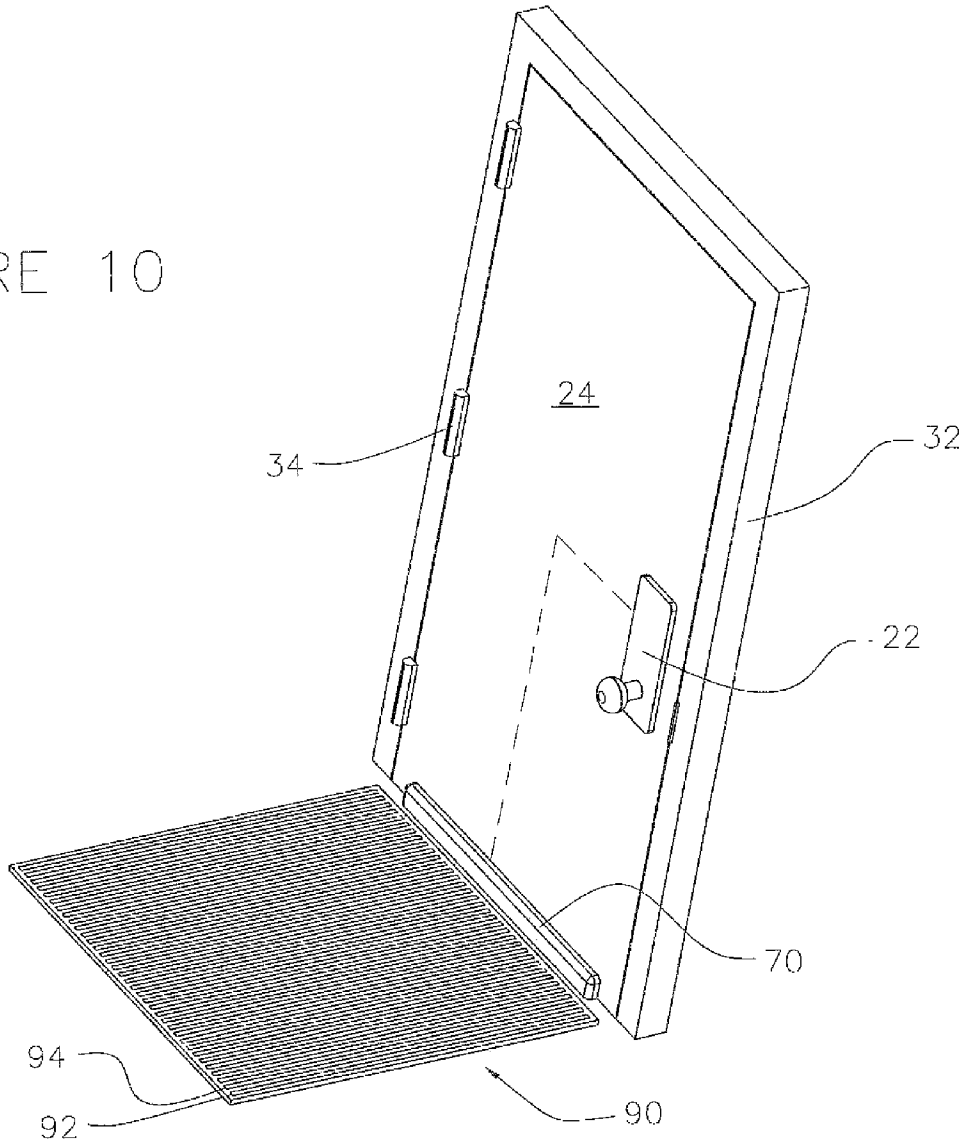
FIG. 10 is a schematic view of an alternative embodiment of a door accessory system for a swinging door.

With reference to FIG. 10, a door accessory system that does include a movable member, in the sense that the magnet (or the coil of wire) is not moved in relation to the door 24, instead the magnet (or the coil of wire) is stationary with respect to the door 24. In this embodiment, the generator housing 70 is disposed adjacent the floor. In the depicted embodiment, a coil of wire (not visible) is disposed in the housing 70. A magnetic fixture 90, which in this embodiment is similar to a floor mat, is disposed adjacent the door 24 and the housing 70 on the floor. The magnetic fixture 90 includes a plurality of magnets, for example, north magnets 92 and south magnets 94 (each of the magnets is not numbered to provide more clarity to the figure). The north magnets 92 and the south magnets 94 can be oriented adjacent one another or take a different configuration if desired. As the door 24 is swung around the hinges 34 the coil of wire (not visible) disposed in the housing 70 moves in relation to the magnetic fixture 90 such that an electrical current and voltage is induced in the coil of wire. The coil of wire can then communicate with the power storage device 14 (FIG. 1) to later power the electric device 16.

A similar configuration can be provided for a sliding door, for example the sliding door 26 depicted in FIGS. 6 and 7. In such a configuration, the coil of wire is disposed in the housing and the magnetic FIG. 90 would be disposed adjacent thereto. Movement of the sliding door along a track, for example the track 36 depicted in FIG. 7, would result in movement of the coil of wire in relation to the magnetic fixture 90. Furthermore, the magnets of the magnetic fixture can take a different shape, for example, when used with a swinging door such as door 24, the magnets can follow the radius of the arc of the door in relation to the hinge 34 so that the coil of wire travels normal to the magnets thus increasing the efficacy of such a system. Also, the magnetic fixture 90 can be located elsewhere other than the floor, for example on a wall or ceiling. Movement of the magnetic fixture typically would result in movement of the housing for the coil of wire so that coil of wire is adjacent to the magnetic fixture such that an electrical current and voltage can be produced in the coil of wire when the coil of wire moves in relation to the magnetic fixture.

Alternatively, the housing, for example housing 70 disclosed in FIG. 10, can include at least one magnet and at least one coil of wire can be disposed in a fixture, which would be similar to fixture 90. In other words, the magnet can attach to a door and move along with the door while the coil of wire can be disposed in a fixture.

A door accessory power system and a method for operating a door accessory power system have been disclosed with reference to certain embodiments. Modifications and alterations will occur to those upon reading and understanding the detailed description. It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A powered door accessory system comprising:

a powered door accessory assembly configured to mount to at least one of an associated door and an associated structure adjacent the associated door;

a generator configured to mount to at least one of the associated door and the associated structure adjacent the associated door and configured to generate an electrical current in response to movement of the associated door, the generator being in electrical communication with the powered door accessory assembly and including a magnet and a coil of wire;

a power storage device in electrical communication with the generator and the powered door accessory assembly; and a movable member configured to connect to the associated door and operably connected with at least one of the magnet and the coil of wire.

2. The system of claim 1, wherein the powered door accessory assembly comprises at least one of a powered door latch actuator, a powered lock assembly, an electric door opener, a push plate actuator, a card reader, an electronic eye, a motion detector and biometric reader.

3. The system of claim 1, wherein the generator includes a coil of wire mounted to the associated door and a magnet mounted adjacent the associated door, whereby movement of the associated door results in movement of the coil of wire in relation to the magnet.

4. The system of claim 1, wherein the generator includes a magnet mounted to the associated door and a coil of wire mounted adjacent the associated door, whereby movement of the associated door results in movement of the magnet in relation to the coil of wire.

5. The system of claim 1, wherein the movable member comprises at least one of a gear, a sprocket, a shaft, a cam, a plunger, a piston rod, a cable, a pulley, a linkage, an arm and a wheel.

6. The system of claim 5, wherein the movable member is operably connected to a biasing member.

7. The system of claim 5, wherein the movable member is operably connected to a plurality of gears.

8. The system of claim 1, wherein the powered door accessory assembly comprises an automated door lock configured to mount to the associated door, and the generator being configured to mount to the associated door.

9. The system of claim 1, wherein the powered door accessory assembly comprises an automated door latch actuator configured to mount to or adjacent a door jamb for the associated door and the generator is configured to mount to or adjacent a door jamb for the associated door.

10. The system of claim 1, wherein the power storage device comprises a capacitor.

11. The system of claim 1, wherein the power storage device comprises a battery.

12. A powered door accessory system comprising:

a powered door accessory assembly configured to mount to at least one of an associated door and an associated structure adjacent the associated door;

a coil of wire configured to mount to at least one of the associated door and the associated structure adjacent the associated door, the coil of wire being in electrical communication with the powered door accessory assembly;

a magnet configured to mount to at least one of the associated door and the associated structure adjacent the associated door, the magnet and the coil of wire cooperating with one another such that movement of the associated door results in movement of the magnet in relation to the coil of wire, or vice versa, whereby an electrical current is developed in the coil of wire; and a movable member configured for connection with at least one of the coil of wire and the magnet and the associated door so that the movable member moves through at least a majority of the range of motion for the associated door as the associated door opens and closes.

13. The system of claim 12, further comprising a power storage device in electrical communication with the coil of wire and the powered door accessory assembly.

14. The system of claim 13, further comprising a switch in electrical communication with the power storage device and the powered door accessory assembly, the switch being configured to control the delivery of power to the powered door accessory assembly from the power storage device.

15. The system of claim 14, further comprising a signal receiver in electrical communication with the switch.

16. The system of claim 14, further comprising a regulator disposed between and in electrical communication with the power storage device and the powered door accessory assembly.

17. A powered door accessory system comprising:

a powered door accessory assembly configured to mount to at least one of an associated door and an associated structure adjacent the associated door;

a coil of wire configured to mount to at least one of the associated door and the associated structure adjacent the associated door, the coil of wire being in electrical communication with the powered door accessory assembly;

a magnet configured to mount to at least one of the associated door and the associated structure adjacent the associated door, the magnet and the coil of wire cooperating with one another such that movement of the associated door results in movement of the magnet in relation to the coil of wire, or vice versa, whereby an electrical current is developed in the coil of wire; wherein the powered door accessory assembly includes an electric drive and a driven member operatively connected to the electric drive, the driven member being configured to cooperate with at least one of a door latch member and a door latch bolt receptacle for the associated door, the driven member being moveable between an extended position and a retracted position, where the driven member is configured to cooperate with the door latch member the driven member being configured such that when the driven member is in the extended position the driven member engages a door latch member for the associated door to displace the door latch member from a door latch receptacle and when the driven member is in the retracted position the driven member is at least partially disposed in the door latch receptacle, and where the driven member is configured to cooperate with the door latch bolt receptacle the driven member being configured such that when the driven member is in the extended position the driven member is at least partially received in the door latch bolt receptacle and when the driven member is in the retracted position the driven member removed from the door latch bolt receptacle.

18. The system of claim 1, wherein the movable member is connected with a door hinge.

19. The system of claim 18, wherein the movable member is a sprocket mounted to a pin of the door hinge.

20. The system of claim 18, wherein the movable member is a rack attached to a plate of the door hinge.

21. The system of claim 1, wherein the movable member is a wheel that engages the ground.

* * * * *